US005478057A

United States Patent [19]

Wilhelmi et al.

[11] Patent Number: 5,478,057

[45] Date of Patent: Dec. 26, 1995

[54] APPARATUS FOR THE HEAT TREATMENT OF WORKPIECES

[75] Inventors: Bernhard Wilhelmi, Linsengericht; Horst Gerdes, Herzberg, both of Germany

[73] Assignee: Leybold Durferrit GmbH, Cologne, Germany

[21] Appl. No.: 355,551

[22] Filed: Dec. 14, 1994

[30] Foreign Application Priority Data

Jan. 7, 1994 [DE] Germany ..... 44 00 326.9

[51] Int. Cl.[6] ..... C21D 1/06

[52] U.S. Cl. ..... 266/257; 266/252; 432/142

[58] Field of Search ..... 266/80, 78, 249, 266/252, 257; 432/141, 142

[56] References Cited

U.S. PATENT DOCUMENTS

| | | | |
|---|---|---|---|
| 804,883 | 9/1901 | Ruggles | 432/142 |
| 931,663 | 11/1908 | Wilbur | 432/142 |
| 4,709,904 | 12/1987 | Schmetz | 266/252 |

FOREIGN PATENT DOCUMENTS

| | | | |
|---|---|---|---|
| 0203454 | 12/1986 | European Pat. Off. | 266/252 |
| 3416902 | 12/1985 | Germany . | |
| 4362121 | 5/1993 | Japan . | |
| 1129251 | 12/1984 | U.S.S.R. . | |

OTHER PUBLICATIONS

Surface, "Standard Rated Rotary Hearth Atmosphere Furnaces" Midland–Ross Corp. Bulletin SC 200 BK–20M–958 Dec. 1968.

*Primary Examiner*—Scott Kastler
*Attorney, Agent, or Firm*—Felfe & Lynch

[57] ABSTRACT

In a furnace operated with hydrogen gas as a cooling gas under positive pressure for the hardening of metallic workpieces, with a housing (2) enclosing a heating chamber for accepting a batch of workpieces, this housing being connected to a vacuum pump and being openable by way of a bottom housing cover (3) Cooling gas is circulated through gas outlets and outlets opening into the heating chamber by the impeller of a motor-blower unit. A heating system is provided on the bottom section (78) of a batch table (8) supported on the housing cover (3) and rotable around a vertical axis (A). A grate formed of bars (34) is mounted above the heating system (37) for supporting the batch of workpieces, and insulating plates (43, 44) are installed underneath the heating system (37). The bottom section (7) is connected on its bottom side to a bearing journal (15), which passes through a bearing ring (5) on the housing cover (3) in a sealed manner, and which is coupled by way of a shaft (16) to a motorized drive (19) which rotates the bottom section (7) and thus the batch table (8).

6 Claims, 1 Drawing Sheet

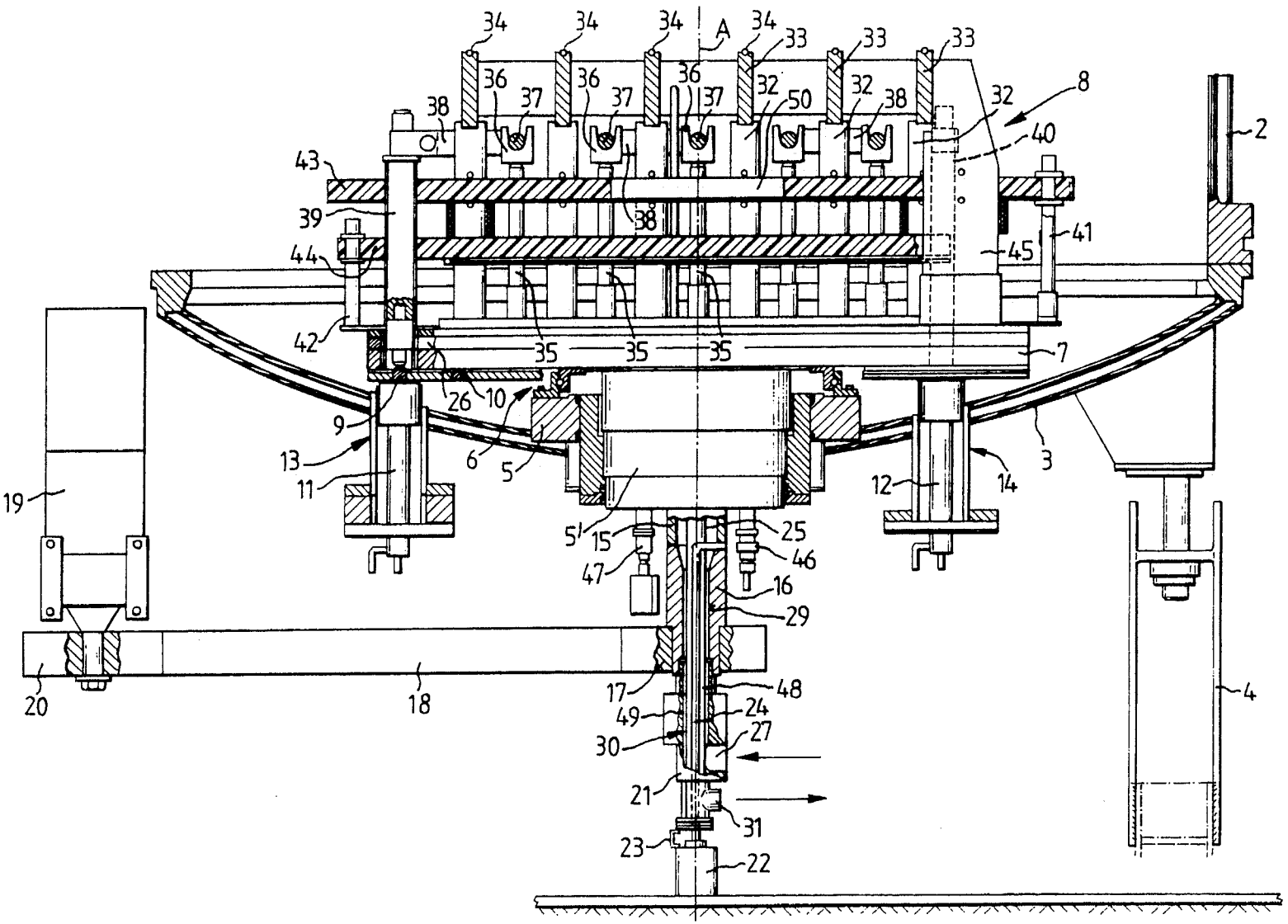
2
4
8
40
41
45
7
3
14
12
32
33
38
50
34
A
36
37
35
25
46
16
29
48
24
27
31
22
21
23
30
49
17
15
47
51
5
6
10
26
9
13
11
18
20
19
43
39
44
42

APPARATUS FOR THE HEAT TREATMENT OF WORKPIECES

BACKGROUND OF THE INVENTION

The invention pertains to apparatus for the heat treatment of workpieces, especially to a furnace operated with hydrogen as a cooling gas under positive pressure for the hardening of metal workpieces. A housing encloses the heating chamber accepting a batch of workpieces and is attached to a vacuum pump. The housing is provided with gas inlets and gas outlets opening into the heating chamber; with a motor-blower unit, the impeller of which circulates the cooling gas; and with a heating system.

DE 34 16 092 to which U.S. Pat. No. 4,709,904 corresponds discloses a vacuum furnace for the heat treatment of a batch of metal workpieces, in which the container is evacuated after the batch has been placed inside and is then flooded with shielding gas. The batch is then raised to the maximum allowable working temperature of the circulation system by a heating system and by circulation of the gas; then it is heated to the desired final temperature of the heat treatment in the stationary shielding gas or under vacuum essentially by the action of thermal radiation. The device is equipped for this purpose with a closeable steel container and an internal heating chamber to accept the batch and with a gas blower and a gas guidance system for producing a circulating flow through the heating chamber. The essentially circular-cylindrical steel container is supported on a stationary support structure; its longitudinal axis is perpendicular to the ground, and an upper section can be lifted up from its supported lower section. The batch itself rests on a support stand, which is itself supported on the housing cover of the lower part.

A disadvantage of the known device is the nonuniform way in which the batch is both heated and cooled, primarily because of the location of the heating elements, which are installed only in the area of the central part of the housing, and also because of the routing of the cooling gas stream, which flows around the batch only in one direction and only peripherally.

SUMMARY OF THE INVENTION

The present invention is based on the task of creating a device which eliminates the disadvantages of the known device, so that, for example, it is possible to heat-treat even rotationally symmetric, thin-walled workpieces on which maximum requirements are imposed with respect to dimensional accuracy, without leading to the need for a later finishing treatment because of the possible distortion or cracking of the workpieces.

This task is solved by a bottom section of a batch table, which is supported on the lower housing cover and which can be rotated around a vertical axis, with a heating system installed on this bottom section, with a grate formed of grating bars to hold the batch of workpieces above the heating system, and with an insulating plate installed underneath the heating system.

The invention leaves room for a wide variety of embodiments. One of them is shown in more detail in the attached drawing.

BRIEF DESCRIPTION OF THE DRAWING

The sole figure is a partial cross section through the lower section of the vacuum chamber of an industrial furnace for the heat treatment of metal workpieces, the rotatable table for the workpieces to be treated being located on the lower housing cover of the vacuum chamber.

DETAILED DESCRIPTION OF THE PREFERRED EMBODIMENT

A vacuum heat treatment furnace of the type in question normally consists of a hollow, cylindrical housing, one end wall of which can be closed by a cover; a blower motor with an impeller installed in the other end wall of the housing; and a hollow, cylindrical batch chamber inside the housing. A batch basket or support grate can be inserted into this chamber, the work-pieces to be treated being placed in the basket or on the grate. Several heating tubes which extend to the immediate vicinity of the support grate and are parallel to the longitudinal axis of the housing; a blower housing is located between the blower motor and the support grate in the interior of the housing; and a heat exchanger, consisting of a coil of tubing through which a coolant passes, is installed in the annular space between the inside wall of the housing and the outside wall of the batch chamber.

The heat treatment furnace is normally connected by way of a suction line to a vacuum pump, and the other end of the suction line leads to a stack. The suction line can be shut off by an evacuation valve. The gas inlet lines open into the hollow, cylindrical housing; these lines are connected to gas tanks and have valves built into them, by means of which the two lines can be shut off.

The figure shows only a lower housing cover 3, which rests on a stand, only one of legs 4 being shown. The cover 3 is rigidly welded to a support ring 5, to which a supporting bearing 6 is attached (ball bearing slewing rim), on which in turn bottom section 7 of a rotating batch table 8 rests. Batch table 8 is provided on its bottom side with slip rings 9, 10, which are aligned with electrical contacts 11, 12, the holders 13, 14 of which are rigidly connected to housing cover 3 and which are designed in such a way that the upper end surfaces of electrical contacts 11, 12 rest with a certain pretension against slip rings 9, 10. The bottom side of bottom section 7 of batch table 8 has a bearing journal 15, which is sealed off with respect to bearing ring 5 and which continues downward as a shaft 16, on which a pulley 17 is mounted in a torsion-proof manner. The pulley is connected by way of a toothed belt 18 or a drive chain to a pulley 20 of a motor-gear box unit 19, so that, by means of motor-transmission unit 19 (with three-phase motor), batch table 8 can be rotated around axis A. Shaft 16 continues downward to pipe section 21, 49, which is connected by way of a support 23 in a torsion-proof manner to a stationary bearing 22, on which a centering rod 24 rests. The rod 24 passes through an inside tube 25 and has the effect that inside tube 25 rotates along with shaft 16 and bearing journal 15 and bottom section 7.

Bottom section 7 is provided with a cavity 26, which is connected to inside tube 25, so that the cooling water flowing upward from connecting socket 27 into the ring-shaped space between inside tube 25 and longitudinal bore 30 in pipe section 21 and through the space 29 between tube 25 and shaft 16 can also flow through cavity 26 in bottom section 7 to cool batch table 8 (rotating cooling water channel). The cooling water returning from cavity 26 flows through inside tube 25 and leaves again through connecting socket 31. The tube 25 is fitted rotably in the stationary pipe section 21 with bearings which are sealed to separate the incoming coolant from the exiting coolant.

A plurality of supports 32 consisting of graphite or ceramic material are mounted on top of bottom section 7 of batch table 8 to hold support pieces 33, on which in turn rods 34 of highly heat-resistant and corrosion-resistant material rest, on which the workpieces to be treated can be laid. Holders 35 are attached to the bottom section parallel to supports 32; the upper ends of these holders are designed as forks 36, in which parallel heating bars 37 are held. These bars 37 are connected by way of conductors 38 to each other and to current-carrying connecting bars 39, 40, which match up with slip rings 9, 10 (carbon slip contacts). Parallel to the two connecting bars 39, 40, additional perpendicular supports 41, 42 are provided, which are anchored permanently to bottom section 7. Each support 41, 42, holds an insulation plate 43, 44, in a plane which is parallel to that of bottom section 7. Furthermore, a bracket 45 is also attached to bottom section 7; this bracket holds support pieces 33, a certain distance apart. Finally, two measurement sensors 46, 47 are provided on bearing ring 5', which are connected by way of sliding contacts (not shown) to the parts of the device mounted on bottom section 7, so that the temperature at various points of the device can be measured. It should also be mentioned that insulation plate 43 (hard graphite felt insulation) is provided with a central opening 50, which makes it possible for the cooling gas to flow upward from below through batch table 8 and thus also through the workpieces which have been laid on the grate formed by 34.

We claim:

1. Apparatus for the heat treatment of workpieces, said apparatus comprising a housing enclosing a heating chamber and having a bottom cover with a central bearing ring, a batch table having a bottom section supported on said bottom cover and rotable relative to said bottom cover about a vertical axis, a bearing journal affixed to said bottom section and passing through said central bearing ring in a sealed manner, a shaft fixed to said bearing journal passing through said central bearing ring co-axially to said vertical axis, a drive system coupled to said shaft for rotating said batch table, a heating system mounted over said bottom section and fixed relative to said batch table, at least one insulation plate between said heating means and said bottom section, and grate means for supporting said workpieces fixed relative to said batch table over said heating system.

2. Apparatus as in claim 1 further comprising cooling channels in said bottom section and intermediate passages in said shaft, said intermediate passages communicating with said cooling channels and a coolant supply.

3. Apparatus as in claim 2 wherein said intermediate passages comprise an inside tube on said vertical axis and an annular channel co-axial to said inside tube, said annular channel being connected to said coolant supply for providing coolant to said cooling channels in said bottom section, said inside tube serving to discharge coolant from said cooling channels.

4. Apparatus as in claim 1 further comprising at least one contact ring fixed to said bottom section concentric to said axis and electrically connected to said heating system, and at least one sliding contact passing in an insulated manner through said cover and connected to a source of electrical power.

5. Apparatus as in claim 1 further comprising at least one bore passing through said bearing ring in said cover and communicating with at least one sensor for monitoring conditions in said housing.

6. Apparatus as in claim 1 wherein said shaft has a passage therethrough wherein a centering rod is situated concentrically and fixed against rotation relative to said shaft, said centering rod having a lower end facing away from the batch table and supported rotably on a stationary bearing block, said block having fixed thereto a sleeve which supports said shaft rotably thereon.

* * * * *